United States Patent [19]

Sakurada et al.

[11] Patent Number: 4,536,030

[45] Date of Patent: Aug. 20, 1985

[54] SEAT WITH ADJUSTABLE SIDE SUPPORT DEVICE

[75] Inventors: Kenichi Sakurada, Yokohama; Takaichi Nishino, Hachioji, both of Japan

[73] Assignees: Nissan Motor Co., Ltd., Yokohama; Tachikawa Spring Company, Limited, Tokyo, both of Japan

[21] Appl. No.: 178,057

[22] Filed: Aug. 14, 1980

[30] Foreign Application Priority Data

Aug. 22, 1979 [JP] Japan ..... 54-106115
Aug. 22, 1979 [JP] Japan ..... 54-106114

[51] Int. Cl.[3] ..... A47C 3/00; A47C 7/46

[52] U.S. Cl. ..... 297/284; 297/459; 297/460

[58] Field of Search ..... 297/284, 116, 466, 486, 297/464, 458, 460

[56] References Cited

U.S. PATENT DOCUMENTS

| | | | |
|---|---|---|---|
| 3,550,953 | 12/1970 | Neale | 297/284 |
| 3,773,382 | 11/1973 | Coursault et al. | 297/284 |
| 3,874,731 | 4/1975 | Jordan | 297/458 |
| 4,295,681 | 10/1981 | Gregory | 297/284 |

FOREIGN PATENT DOCUMENTS

| | | | |
|---|---|---|---|
| 2721539 | 11/1978 | Fed. Rep. of Germany | 297/284 |
| 2740268 | 3/1979 | Fed. Rep. of Germany | 297/284 |
| 2056850 | 3/1981 | United Kingdom | 297/284 |

*Primary Examiner*—Francis K. Zugel
*Attorney, Agent, or Firm*—Schwartz, Jeffery, Schwaab, Mack, Blumenthal & Evans

[57] ABSTRACT

Two spaced wings are mounted on the inner side of a seatback base plate in a manner to pivot about respective axes parallel to the seatback plane. Adjusting levers which move synchronously are connected at respective ends thereof to the wings to transmit the movement of the levers to the wings. An operating device is connected to one of the levers for manually adjusting the lever position.

10 Claims, 9 Drawing Figures

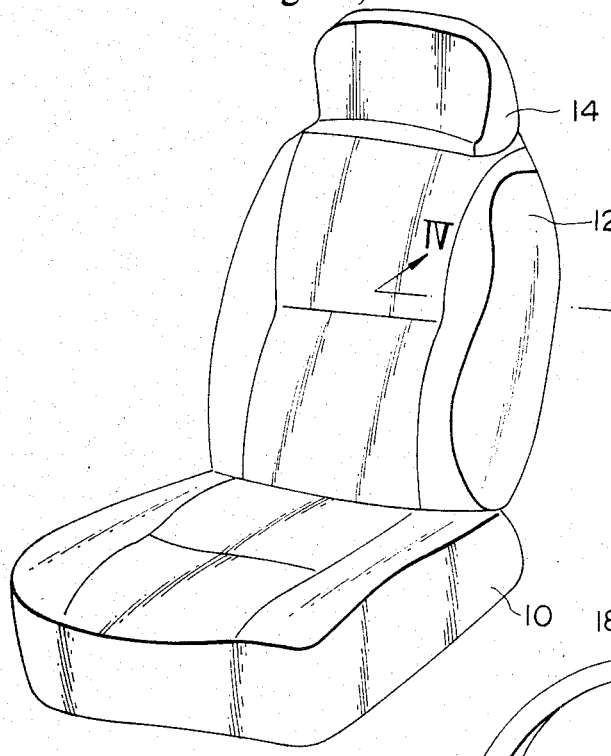
FIG. 1
FIG. 2
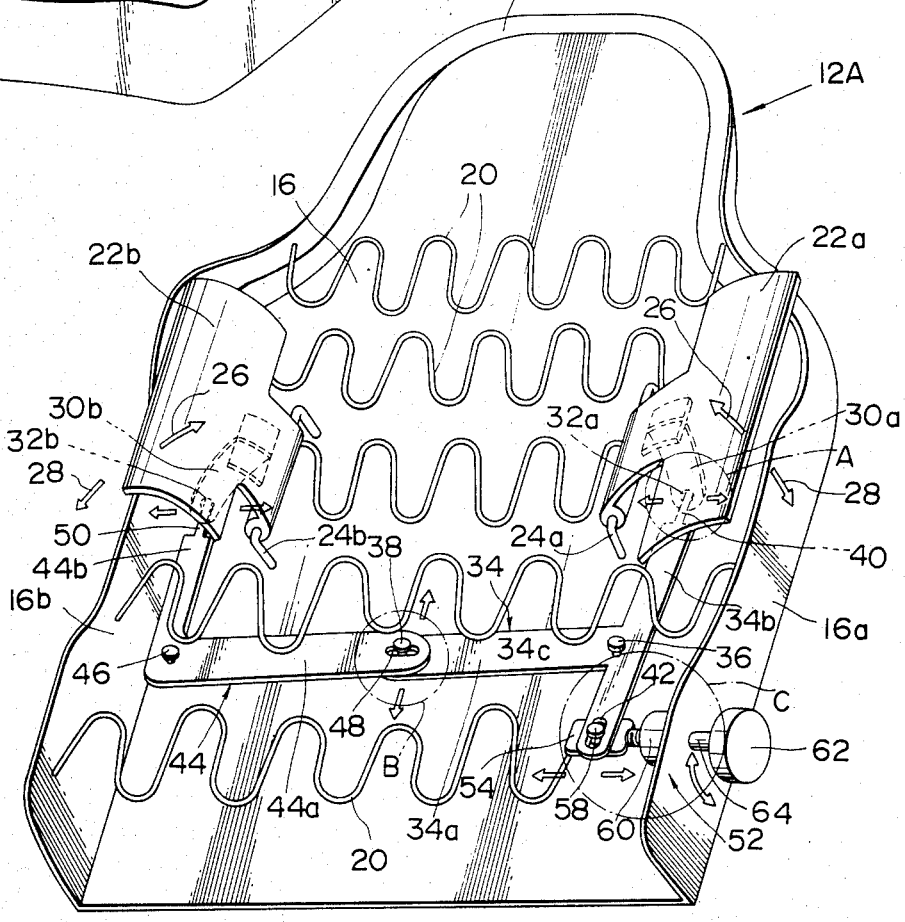

SEAT WITH ADJUSTABLE SIDE SUPPORT DEVICE

BACKGROUND OF THE INVENTION

1. Field of the Invention

The present invention relates in general to a seat and more particularly to a seat having an adjustable side support formed with the seatback thereof.

2. Description of the Prior Art

For increased sitting comfort, adjustable side support devices capable of adjustably supporting the sides of a seated occupant have been proposed. The prior art occupant's side support devices comprise a pair of pad members which are separate relative to the seatback proper and are mounted on the sides of the seatback proper to be adjustably movable in fore-and-aft directions.

In the conventional seat, however, there is a drawback, originating from the separate construction of the pad members relative to the seatback proper, in that the presence of the pad members is clearly apparent, resulting in an aesthetically unappealing seat construction. In fact, the seat with such side supporting pad members is limited to very specified designs.

SUMMARY OF THE INVENTION

According to the present invention, there is provided a seat having an adjustable occupant's side support device formed as part of the seatback. The support device comprises spaced wings mouned on the front side of the seatback to pivot about respective axes parallel to the seatback plane, adjusting levers for selectively adjusting the position of the wings relative to the seatback, first means for connecting respective adjusting levers to the wings for transmitting the adjusting movement of the levers to the wings, second means synchronizing the movement of the respective adjusting levers, and operating means for manually adjusting the position of the respective adjusting levers.

It is an object of the present invention to provide a seat having an adjustable occupant's side support device which assures a well-designed seat construction.

It is another object of the present invention to provide a seat having an adjustable occupant's side support device which is adjustable over a wide range in accordance with the physical characteristics of the occupant.

Other objects and advantages of the present invention will become clear from the following description when taken in conjunction with the accompanying drawings.

BRIEF DESCRIPTION OF THE DRAWINGS

FIG. 1 is a perspective view of a seat according to the present invention;

FIG. 2 is a perspective view of the assembled parts of the first embodiment of the adjustable side support device according to the present invention;

DETAILED DESCRIPTION OF THE INVENTION

Figure 3:
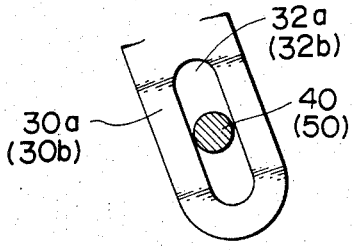
FIG. 3 is an enlarged sectional view of a part enclosed by circle A of FIG. 2.
Figure 4:
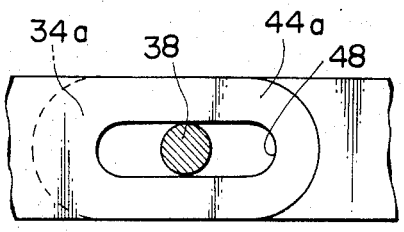
FIG. 4 is an enlarged sectional view of a part enclosed by circle B of FIG. 2.

Referring to FIG. 1, these is shown a perspective view of the seat according to the present invention. In this drawing, a seat portion, a seatback portion and a head rest portion are denoted by reference numerals 10, 12 and 14 respectively. As will become clear as the description proceeds, the seatback portion 12 includes a seat occupant's side support device.

Referring to FIGS. 2 to 6, especially to FIG. 2, there is shown the seatback portion 12A of the first embodiment of the invention, some parts being omitted for clarification. The seatback portion 12A comprises a seatback base plate 16 having side flanges 16*a* and 16*b* which are bent at right angles relative to the major portion of the base plate 16. A generally U-shaped tube member 18 is connected at its leg portions to the flanges 16*a* and 16*b* to form the upper base construction of the seatback portion. S-shaped wire springs 20 span between the leg portions of the tube member 18 and between the flanges 16*a* and 16*b* of the base plate 16, as shown. Although not shown in FIG. 2, a flexible pad member having a suitable thickness lies on the S-shaped springs 20.

Two wing plates 22*a* and 22*b*, each having a gently curved major section, are pivotally mounted on respective hinge pins 24*a* and 24*b* which are securely mounted to the inner side of the seatback base plate 16. Preferably, the pins 24*a* and 24*b* are arranged parallel to the longitudinal axis of the seatback 12A so that the wing plates 22*a* and 22*b* pivot about respective axes in a manner indicated by the arrows 26 and 28. Respective arm members 30*a* and 30*b* are fixed to the back sides of the wing plates 22*a* and 22*b* to move therewith. As best shown in FIG. 3, the free ends of the arm members 30*a* and 30*b* are formed with respective longitudinal elongate openings 32*a* and 32*b*.

A generally T-shaped lever 34, including first, second and third arm sections 34*a*, 34*b* and 34*c*, is connected by a pivot pin 36 to the seatback base plate 16 to pivot about the pin 36 in a plane parallel, to the major portion of the seatback base plate 16. As shown, the pivot pin 36 is positioned at a portion where the first, second and third arm sections are joined. The first lever arm section 34*a* has at its free end a pin 36 cooperating with an L-shaped lever 44; the second arm section 34*b* is formed at its free end with a longitudinally extending pin 40, slidably received in the elongate opening 32*a* of the arm member 30*a*, as is best shown in FIG. 3; and the third arm section 34*c* includes at its free end a longitudinally extending elongate opening 42, cooperating with an operating device 52, to be described hereinbelow.

The generally L-shaped lever 44, including first and second arm sections 44*a* and 44*b*, is connected by a pivot pin 46 to the seatback base plate 16 to pivot about the pin in a plane parallel to the plate. The pin 46 is positioned where the first and second arm sections 44*a* and 44*b* are joined. The first lever section 44*a* includes at its free end a longitudinally extending elongate opening 48, for receiving the afore-mentioned T-shaped lever first arm section pin 38 in a manner best shown in FIG. 4. The L-shaped lever second section 44*b* includes at its free end a longitudinally extending pin 50 slidably received in the arm member elongate opening 32*b* in substantially the same manner as the T-shaped lever pin 40 and the elongate opening 32*c* mentioned above.

Figure 5:
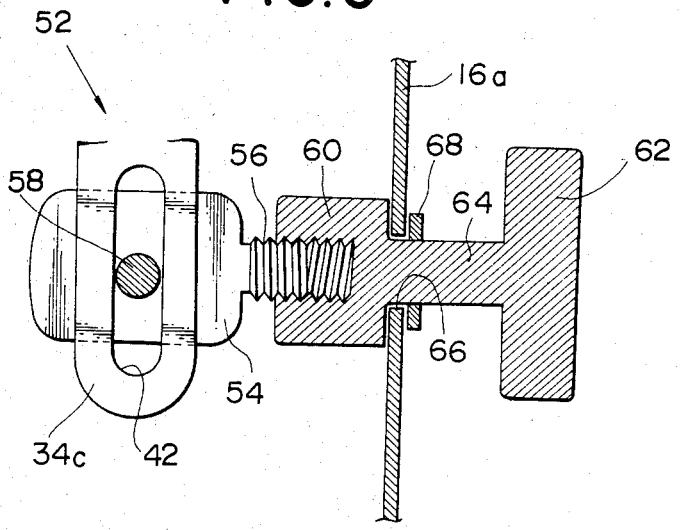
FIG. 5 is an enlarged sectional view of a part enclosed by circle C of FIG. 2.

As best shown in FIG. 5, the operating device 52 cooperating with the T-shaped lever third arm section 34*c* comprises a generally rectangular flat plate 54 having an externally threaded shaft 56 formed therewith. A pin 58 extends from the flat plate 54 at a right angle relative to the threaded shaft 56 and is slidably received in the T-shaped lever third arm section elongate opening 42. The operating device 52 further includes a nut 60, having an internally threaded bore engageable with the threaded shaft 56. The nut 60 is integrally connected to a control knob 62 through a shaft portion 64 rotatably received in an opening 66 formed in the seatback side flange 16*a*. A retaining washer 68 is secured to the shaft portion 64 to prevent excessive axial movement of the shaft portion 64 relative to the side flange 16*a*.

Figure 6:
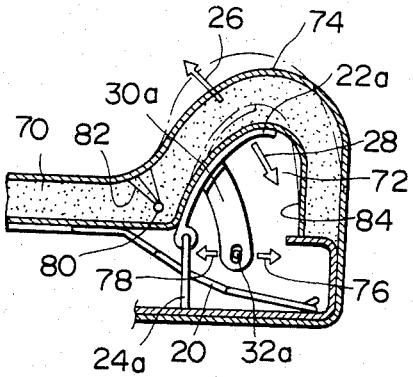
FIG. 6 is a sectional view of an essential part of the seat of the first embodiment, taken along line IV—IV of FIG. 1.

FIG. 6 shows the manner in which the wing plate 22*a* operates in the seatback for providing the front side of the seatback with the side support device. Since the wing plates 22*a* and 22*b* operate identically, the following description is directed only to the manner depicted in FIG. 6. As shown in this drawing, a flexible pad member 70 constructed of, for example polyurethane foam, lies on the S-shaped wire springs 20. The pad member 70 is formed with a pocket 72 for receiving the wing plate 22*a*. The wing plate 22*a* is arranged to contact the inner surface of the pocket 72 so that upon movement of the lever pin portion 40 in the directions of the arrows 76 and 78, the wing plate moves as shown by the arrows 26 and 28 between the position illustrated by a phantom line and the position illustrated by a solid line.

A framework line 80 is embedded in the pad member 70 to bind thereto pulling wires 82 which pull the internal angle section of the side support portion toward the framework line. The back surface of the pad member 70 is lined with a back cloth 84.

When, in operation, the control knob 62 is turned to move the flat plate member 54 in a leftward direction as shown in FIG. 2, the T-shaped lever 34 pivots about the pivot pin 36 in a clockwise direction to urge the arm member 30*a* to the right in the direction of arrow 76 to pivot the wing plate 22*a* about the hinge pin 24*a* in the direction of arrow 26. The pivoting movement of the wing plate 22*a* urges the pad member side support portion 74 (see FIG. 6) forwardly, in the direction of the arrow 26.

Additionally, clockwise pivoting of the T-shaped lever 34 about the pivot pin 36 causes synchronously counterclockwise pivoting of the L-shaped lever 44 about the pivot pin 46 so that the arm member 30*b*, and thus the wing plate 22*b*, pivot about the hinge pin 24*b* in the direction of the arrow 26, as shown in FIG. 2. The movement of the wing plates 22*a* and 22*b* thus provided urges the pad member support portions forwardly.

When the control knob 62 is turned in the reverse direction to move the flat plate member 54 in a rightward direction as shown in FIG. 2, the T-shaped lever 34 pivots in the counterclockwise direction and the L-shaped lever 44 pivots in the clockwise direction. With these movements of the levers, the wing plates 22*a* and 22*b* pivot in the direction of the arrows 28, with the result that the seatback side support portions move backwardly.

Figure 7:
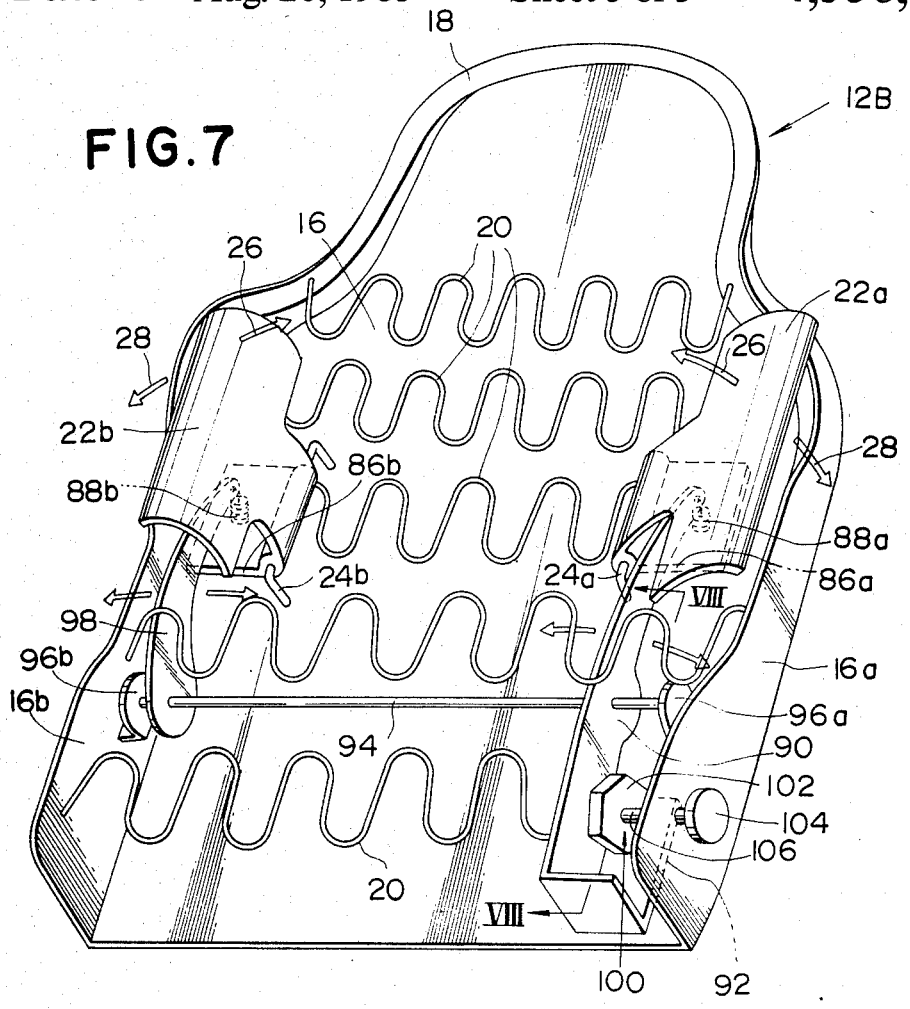
FIG. 7 is a view similar to FIG. 2, showing the assembled parts of a second embodiment of the adjustable side support device according to the present invention.
Figure 8:
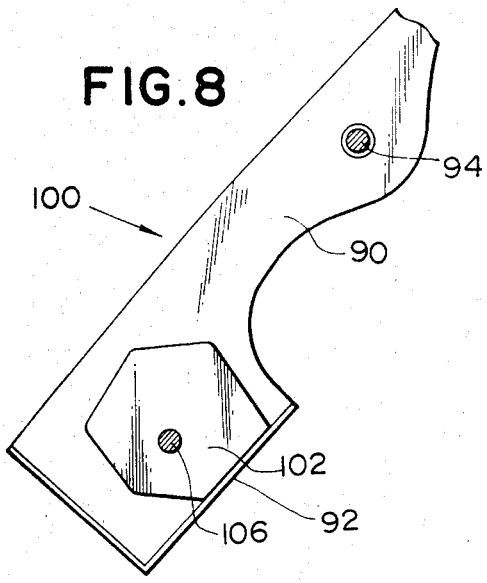
FIG. 8 is an enlarged sectional view taken along line VIII-VIII of FIG. 7.
Figure 9:
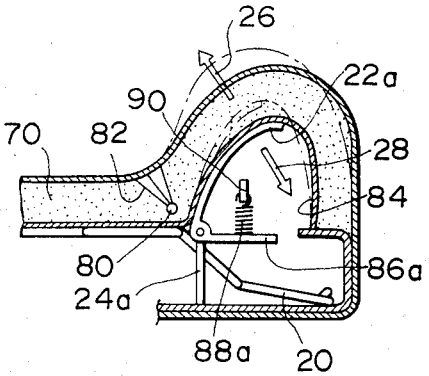
FIG. 9 is a sectional view similar to FIG. 6, showing the mechanism of the second embodiment of the invention.

Referring to FIGS. 7 to 9, there is shown the seatback portion of the second embodiment according to the present invention. Similar parts to those of the first embodiment are designated by the same numerals. The seatback portion 12B of the second embodiment comprises a seatback base plate 16, a generally U-shaped tube member 18, S-shaped wire springs 20 and a flexible pad member 70 (see FIG. 9) arranged in the same manner as in the first embodiment.

Two wing plates 22*a* 22*b*, each having a gently curved major section, are pivotally mounted on hinge pins 24*a* and 24*b* which are securely mounted to the inner side of the seatback base plate 16. As in the first embodiment, the pins 24*a* and 24*b* may be arranged parallel to the longitudinal axis of the seatback 12B so that the wing plates 22*a* and 22*b* pivot in the direction of the arrows 26 and 28. As shown, the wing plates 22*a* and 22*b* are respectively formed with arm sections 86*a* and 86*b* which extend from the portions where the major sections of the wing plates 22*a* and 22*b* are pivotally supported by the hinge pins 24*a* and 24*b*.

A lever 90 having at one end a normally bent section 92 is securely mounted on a rotatable shaft 94 to pivot about the shaft axis. The shaft 94 spans between the side flanges 16*a* and 16*b* of the seatback base plate 16, and is pivotally supported in bearing members 96*a* and 96*b* fixed to the side flanges 16*a* and 16*b*. As shown, the other end of the lever 90 extends into the space defined by the wing plate major section and arm section 86*a* and is connected to the arm section through a coil spring 88*a*.

A shorter lever 98 is securely mounted at one end to the shaft 94 to pivot therewith. The other end of the lever 98 extends into the space defined by the wing plate major section and arm section 86*b* and is connected to the arm section through a coil spring 88*b*.

An operating device 100 cooperates with the lever normally bent section 92. The device 100 comprises a cam 102 having a plurality of flat cam surfaces which are progressively spaced from the rotational axis of the cam as shown in FIG. 8. The cam 102 is integrally connected to a control knob 104 through a shaft portion 106 which is rotatably received in an opening (no numeral) formed in the seatback base plate side flange 16*a*. Although not shown, a suitable retaining washer is secured to the shaft portion 106 to prevent excessive axial movement thereof relative to the side flange 16*a*. The operating device 100 is so positioned that the cam surfaces of the cam 102 selectively engage the lever bent section 92 upon rotation of the control knob 104.

As will be understood from FIG. 9, similar to the first embodiment, the wing plates 22*a* and 22*b* are arranged to contact inner surfaces of the pad member pockets 72 so that upon pivoting movements of the wing plates 22*a* and 22*b* in the directions of the arrows 26 and 28, the seatback side support portions move between the foremost and backmost positions.

When, in operation, the control knob 104 is turned to rotate the cam 102 to change the cam surfaces that engage the lever bent section 92, the lever 90, and thus the shorter lever 98, make stepwise pivots in the same direction about the axis of the shaft 94. This causes the respective levers 90 and 98 to urge respective springs 88*a* and 88*b* to pivot respective arm sections 86*a* and 86*b*, thereby pivoting the wing plates 22*a* and 22*b* about the pins 24*a* and 24*b* in the direction of the arrow 26 or 28. The movement of the wing plates 22*a* and 22*b* thus provided urges the seatback side support portions forwardly and backwardly.

With the construction of the seat according to the present invention, the following advantages are achieved.

It is unnecessary to construct the side support portions as separate members of the seat proper. Thus, the external appearance of the seat is not affected by the provision of the side support adjusting device.

Further, in the second embodiment, the coil springs 88*a* and 88*b* absorb the impact force which may be applied to the seatback when a seat occupant's back presses strongly upon the seatback.

What is claimed is:

1. In combination with a vehicle seat having a backrest portion and a seating portion, a pair of movable lateral bolster sections mounted on opposite sides of at least one of said portions and projecting therefrom, and adjustment means including a pair of drive members, for selectively and simultaneously moving the bolster sections in a controlled fashion between a first lateral support position and a second lateral support position, said adjustment means being adapted to maintain the bolster sections in the first and second lateral positions wherein each of said bolster sections has inner and outer parts, said sections being connected at opposite sides of said one of said portions at their inner parts and wherein said one of said portions includes a frame assembly and wherein each of said bolster sections includes a rigid support paddle, having an outer free end portion and an inner, supported end portion, the inner end portion of said support paddle being hingedly connected to said frame assembly to permit the support paddle to rotate about a first longitudinal axis and wherein each support paddle is hingedly connected to its respective drive member to permit the support paddle to rotate with respect to the drive member about a second longitudinal axis spaced away from the first longitudinal axis to move the free end portion of the support paddle about the first longitudinal axis, coupling means pivoted to said frame assembly to rotate thereon about a pivot point, said coupling means interconnecting said drive members, operating means including a rotary drive shaft rotatably supported by said frame assembly with handle means for manually rotating said drive shaft, a coupling member threaded on said drive shaft to be movable along said shaft, said coupling member coupled to said coupling means whereby movement of said coupling member along said shaft as a result of the manual rotation of said shaft causes said coupling means to rotate about said pivot point on said frame assembly to cause said drive members to simultaneously move said support paddles.

2. In combination with a vehicle seat having a backrest portion and a seating portion, a pair of movable lateral bolster sections mounted on opposite sides of at least one of said portions and projecting therefrom, and adjustment means including a pair of drive members, for selectively and simultaneously moving the bolster sections in a controlled fashion between a first lateral support position and a second lateral support position, said adjustment means being adapted to maintain the bolster sections in the first and second lateral positions wherein each of said bolster sections has inner and outer parts, said sections being connected at opposite sides of said one of said portions at their inner parts and wherein said one of said portions includes a frame assembly and wherein each of said bolster sections includes a rigid support paddle, having an outer free end portion and an inner, supported end portion, the inner end portion of said support paddle being hingedly connected to said frame assembly to permit the support paddle to rotate about a first longitudinal axis and wherein each support paddle is hingedly connected to its respective drive member to permit the support paddle to rotate with respect to the drive member about a second longitudinal axis spaced away from the first longitudinal axis to move the free end portion of the support paddle about the first longitudinal axis, coupling means pivoted to said frame assembly to rotate thereon about a pivot point, said coupling means interconnecting said drive members, operating means including a rotary drive shaft rotatably supported by said frame assembly with handle means for manually rotating said drive shaft, a coupling member threaded for connection with said drive shaft to be movable along the longitudinal axis thereof, said coupling member coupled to said coupling means whereby movement of said coupling member along the longitudinal axis of said shaft as a result of the manual rotation of said shaft causes said coupling means to rotate about said pivot point on said frame assembly to cause said drive members to simultaneously move said support paddles.

3. A seat having a seatback with adjustable occupant's side support devices, comprising:

a seatback base plate having mutually spaced and opposed side flanges;

wire springs overlying said base plate and extending between said side flanges;

a flexible pad member supported on said wire springs, said pad member being integrally formed along its sides with pockets which open towards said base plate;

wings received in said pockets, said wings being arranged to pivot about axes parallel to the plane of said seatback base plate;

a pair of pivotal adjusting levers interposed between said base plate and the wire springs supporting said flexible pad member;

first means for connecting each adjusting lever to one of said wings;

second means for mechanically interconnecting said adjusting levers; and operating means for simultaneously adjusting the angular positions of said wings relative to said base plate by pivotally manipulating said adjusting levers; wherein said wings pivot about respective axes parallel to the longitudinal axis of the seatback; wherein said adjusting levers each have at least L-shaped sections respectively which pivot in a plane parallel to said seatback base plate, and which include respective pin sections extending toward said wings respectively, and wherein one of said adjusting levers includes an extension for connection with said operating means.

4. A seat having a seatback with adjustable occupant's side support devices, comprising:

a seatback base plate having mutually spaced and opposed side flanges;

wire springs overlying said base plate and extending between said side flanges;

a flexible pad member supported on said wire springs, said pad member being integrally formed along its sides with pockets which open towards said base plate;

wings received in said pockets, said wings being arranged to pivot about axes parallel to the plane of said seatback base plate;

a pair of pivotal adjusting levers interposed between said base plate and the wire springs supporting said flexible pad member;

first means for connecting each adjusting lever to one of said wings;

second means for mechanically interconnecting said adjusting levers; and operating means for simultaneously adjusting the angular positions of said wings relative to said base plate by pivotally manipulating said adjusting levers; wherein said wings pivot about respective axes parallel to the longitudinal axis of the seatback; wherein said wings include respective arm portions for connecting said wings to said first means, and wherein said adjusting levers pivot about a common axis perpendicular to the longitudinal axis of said seatback, one of said adjusting levers including an extension for connection with said operating means.

5. A seat as claimed in claim 3, wherein said first means comprises respective arms securely connected to said wings to pivot therewith, said arms including respective elongate openings therein for receiving said pin sections of said adjusting levers respectively for transmitting the movement of said adjusting levers to said wings.

6. A seat as claimed in claim 5, wherein said second means comprises a pin mounted on one of the adjusting levers, said pin being slidably received in an elongate opening formed in the other adjusting lever.

7. A seat as claimed in claim 6, wherein said operating means comprises:

a member having a flat portion, a pin extending normally from said flat portion and a threaded shaft extending from said member at a right angle relative to said pin; and a control knob having an internally threaded bore for receiving said threaded shaft, said pin being slidably received in an elongate opening formed in an extension of one of said adjusting levers.

8. A seat as claimed in claim 4, wherein said first means comprises respective springs which connect respective arm portions of said wings to said adjusting levers for transmitting the movement of said adjusting levers to said wings.

9. A seat as claimed in claim 8, wherein said second means comprises a shaft having said adjusting levers securely mounted thereto.

10. A seat as claimed in claim 9, wherein said operating means comprises:

a cam mounted to a control knob for rotation therewith, said cam having a plurality of flat cam surfaces progressively spaced from the axis of rotation; and a cam follower member formed on said extension of said one of the adjusting levers, said cam follower member being engageable with said flat cam surfaces of the cam for selectively pivoting said adjusting levers to adjust the position of said wings.

* * * * *